US006655812B2

(12) United States Patent
Parker et al.

(10) Patent No.: US 6,655,812 B2
(45) Date of Patent: Dec. 2, 2003

(54) FLOATING ELECTRONIC LIGHT DISPLAY FOR USE IN PONDS AND SWIMMING POOLS

(76) Inventors: Stephen Martin Parker, 3945 Deerfield St., High Point, NC (US) 27265; Robert Gottfried Simmen, 1004 Old Lantern Ct., Raleigh, NC (US) 27614

( * ) Notice: Subject to any disclaimer, the term of this patent is extended or adjusted under 35 U.S.C. 154(b) by 0 days.

(21) Appl. No.: 10/084,808

(22) Filed: Feb. 27, 2002

(65) Prior Publication Data

US 2003/0161138 A1 Aug. 28, 2003

(51) Int. Cl.[7] ..... F21W 131/401

(52) U.S. Cl. ..... 362/101; 362/184; 362/158; 362/276; 362/802

(58) Field of Search ..... 362/101, 184, 362/191, 190, 276, 158, 802; 43/17.5, 17.6

(56) References Cited

U.S. PATENT DOCUMENTS 3,748,457 A * 7/1973 Balitzky et al. ..... 240/6.4 F
4,394,716 A * 7/1983 Campagna et al. ..... 362/158
5,351,432 A * 10/1994 Tse ..... 43/17.5
5,758,449 A * 6/1998 Munsterman et al. ..... 43/17
6,502,953 B2 * 1/2003 Hajianpour ..... 362/186

* cited by examiner

*Primary Examiner*—Laura K. Tso
(74) *Attorney, Agent, or Firm*—Blank Rome LLP

(57) ABSTRACT

A decorative flashing light system designed to float in ponds, pools and swimming pools that is independent of wiring harnesses and external power supplies. The system consists of a buoyant, translucent shell 16 that encloses a light array circuit assembly 20, and a battery(s) 24, which is kept in place by a waterproof reseal-able cap 28. The flash pattern of the light sources as well as the intensity, frequency, duration and duty cycles are all pre-programmed into the electronic circuitry 10. An anchoring tether 30 allows the display to be held in position rather than free-floating if desired.

13 Claims, 4 Drawing Sheets

Fully Assembled
Pond Light Array
Cut-Away View

Light Array
PC Board
Front and
Side View

Typical Shell Assembly

Fully Assembled
Pond Light Array
Cut-Away View

Alternate Float /
TableTop
Design

FLOATING ELECTRONIC LIGHT DISPLAY FOR USE IN PONDS AND SWIMMING POOLS

CROSS REFERENCE TO RELATED APPLICATIONS

Not applicable.

BACKGROUND

1. Field of Invention

This invention relates to the design of a buoyant, waterproof flashing light array that is battery powered and used as decorative lighting for ponds, pools and swimming pools.

2. Description of Prior Art

With the increased installation of backyard garden ponds, fishponds and swimming pools, homeowners are looking for lighting alternatives that will enhance these areas during night hours and especially during festive outdoor occasions. This invention incorporates a battery powered light array in a buoyant, waterproof, translucent case that will float on water and either drift with the current or be anchored by tether to a given spot. As compared to existing "floating lights", these displays are self-contained battery powered devices and require no outboard electrical harnessing or power supplies. Also, these light displays are flashing while in use rather than in a constant "on" mode, the produced effect being from complex blink patterns to simple "fireflies in a jar". An alternative design would be used indoors as a children's night-light or a tabletop piece.

SUMMARY

In accordance with the present invention, a formed translucent shell that is waterproof and can incorporate light array circuitry and battery packs in its confines. One end of the shell will incorporate a removable, reseal-able cap to provide component maintenance and insure protection from the outdoor environments.

OBJECTS AND ADVANTAGES

Several objects and advantages of the present invention are:

a) to provide a decorative light array that is battery powered and does not require external power supplies and/or power harness cords, b) to provide a decorative light array that can float in water-filled pools, ponds and swing pools, c) to provide a light array that is capable of many different light flashing programs, producing an active, energetic light array.

d) to provide a decorative light array that is convenient to use and maintain, e) to provide a decorative light array that can be anchored by a tether in one position while floating, f) to provide decorative light array that incorporates a reseal-able cap for easy access to internal components.

g) to provide a decorative light array whose shell is made from translucent material that provides for adequate buoyancy and circuit component protection.

DRAWING FIGURES

Figure 1:
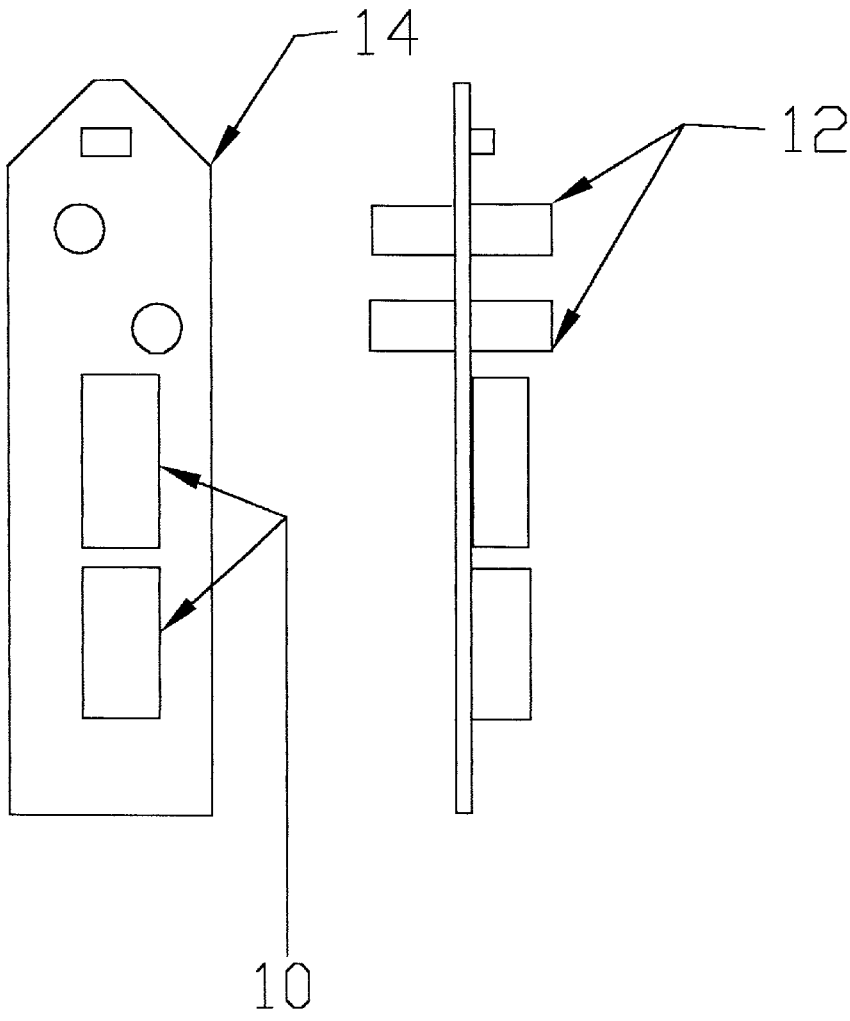
FIG. 1 shows a typical light array printed circuit board
Figure 2:
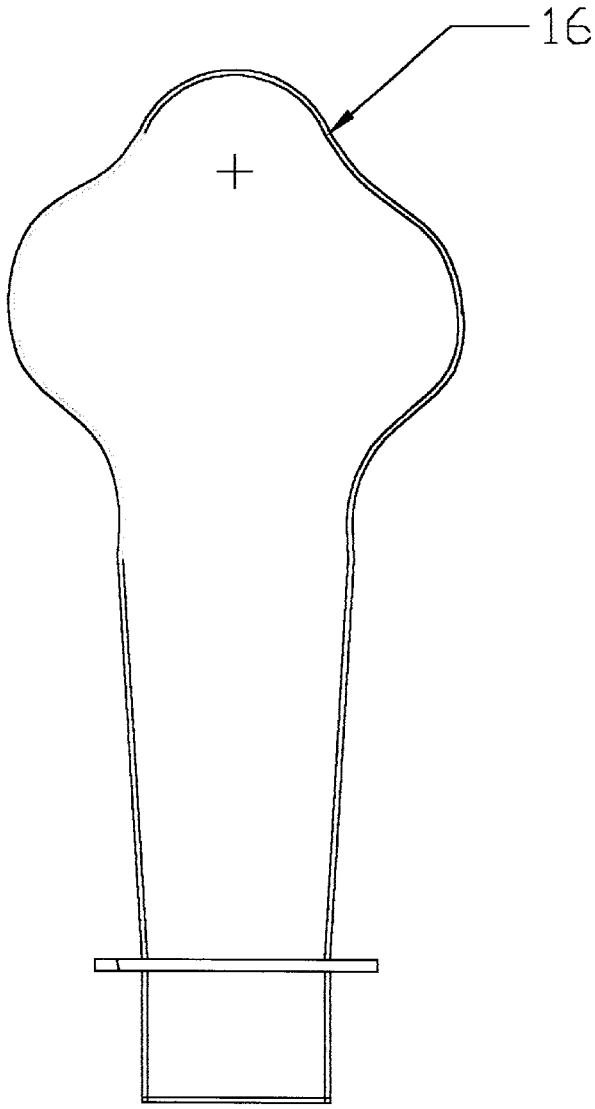
FIG. 2 shows a typical shell assembly (empty) without reseal-able cap

| Reference Numerals in Drawings | |
|---|---|
| 10 | Integrated circuits |
| 12 | Light Sources (LED's) |
| 14 | Printed circuit board |
| 16 | Translucent shell |
| 18 | Translucent shell |
| 20 | Light array circuit assy. |
| 22 | Expected waterline |
| 24 | Battery(s) |
| 26 | Battery interconnect |
| 28 | Reseal-able cap |
| 30 | Anchor and tether |
| 32 | Light array circuit assy. |
| 34 | Translucent shell |
| 36 | Battery(s) |
| 38 | Reseal-able cap |

DESCRIPTION—FIG. 3—PREFERRED EMBODIMENT

Figure 3:
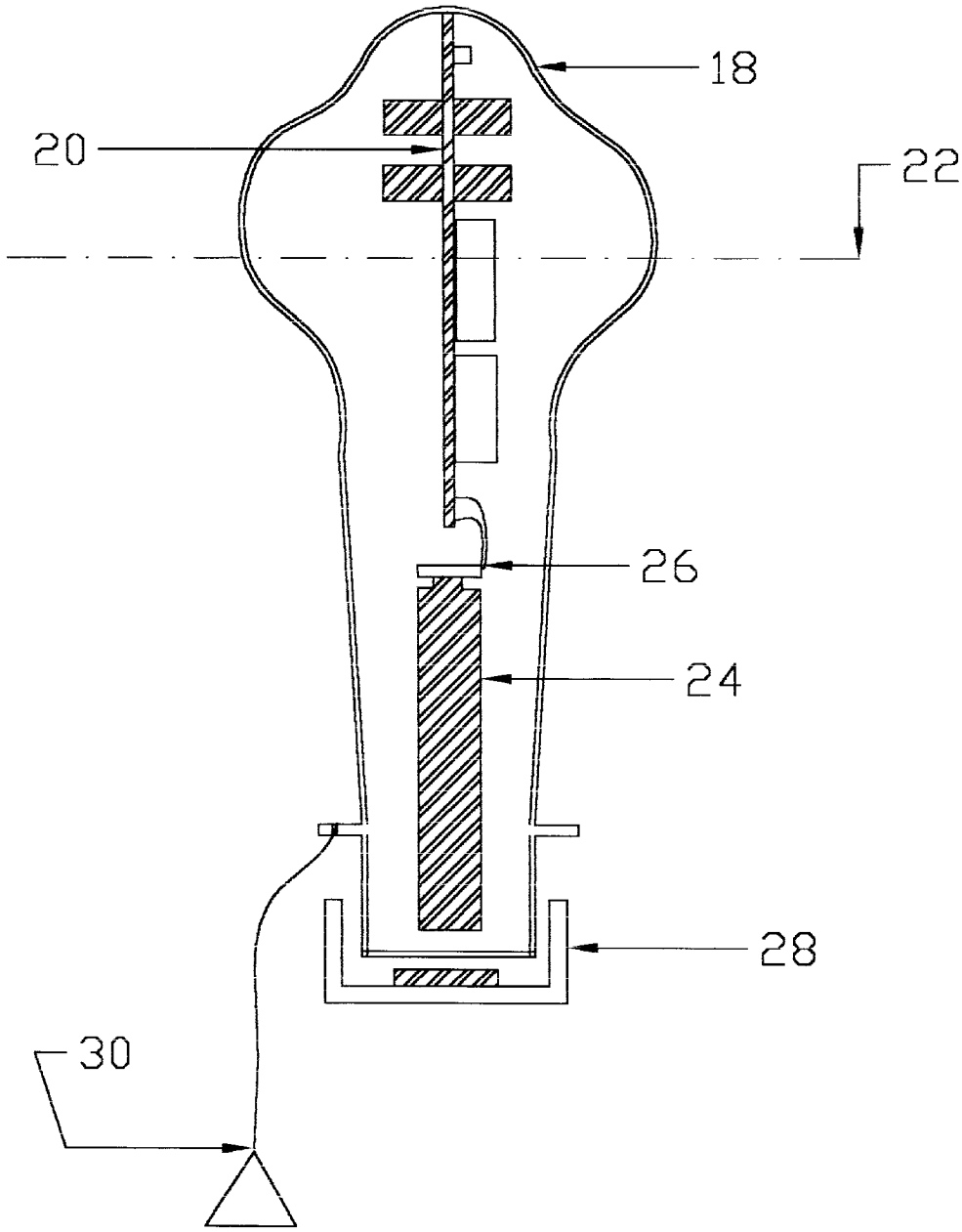
FIG. 3 shows a typical light array fully assembled in the translucent shell with battery pack, reseal-able cap and anchor.
Figure 4:
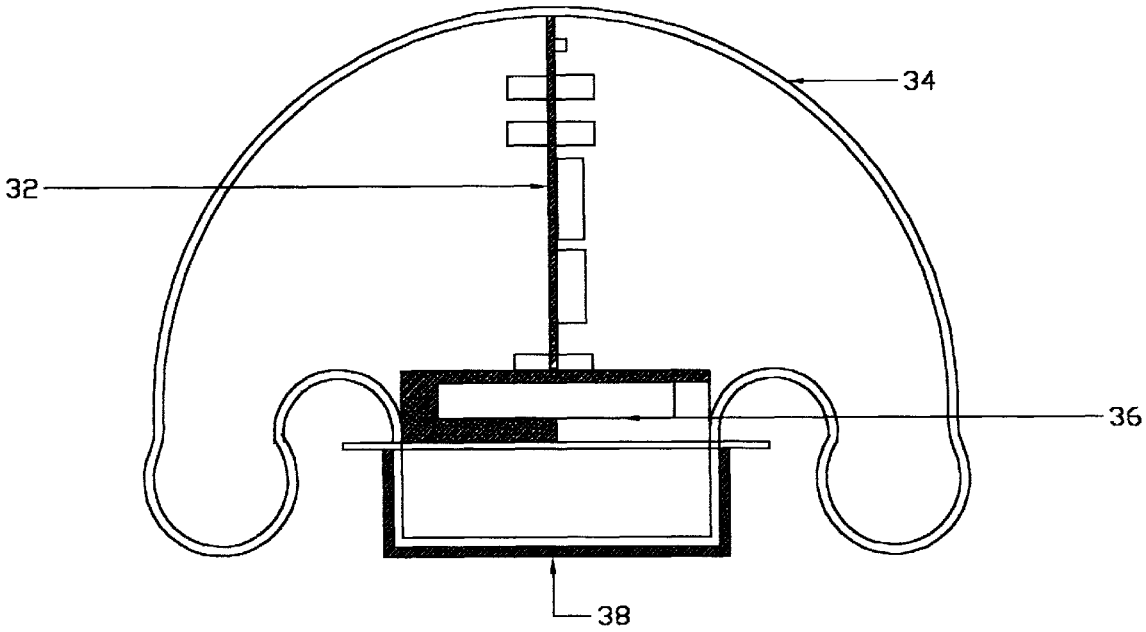
FIG. 4 shows an alternative embodiment (floating or table-top)

A preferred embodiment of the present invention is illustrated in FIG. 3 (fully assembled light display). This assembly consists of a hollow, waterproof translucent shell 16, typically made of blow-molded plastic, which encompasses a light array circuit assembly 20 and battery power source 24. The light array circuit assembly is typically comprised of various electronic components 10 such as integrated circuits, resistors, diodes, etc., mounted on a printed circuit board 14. This electronic circuit controls the light output attributes such as flash rate and frequency, period, brightness and sleep modes of the lamps or LED's 12. Attached to the light array circuit assembly is a battery(s) 36 that powers the array. These batteries can be of the standard dry cell or rechargeable types. Sealing of the shell is done with press or screw-on cap 28 that fastens to the bottom of the shell. When in use in ponds or pools, the floating display can be left free to float with the current or fixed in position by means of a tether and anchor system 30.

DESCRIPTION—FIG. 4—ALTERNATIVE EMBODIMENT

An alternative embodiment is shown in FIG. 9 incorporates similar components but incorporates a shell design 34 that allows the display to float on the water or be placed on a tabletop or similar flat surface.

ADVANTAGES

From the descriptions above, a number of advantages of our floating light display become evident:

a) The display assembly is designed to be a sealed unit and impervious to water and the elements.

b) By changing the color, number and intensity of the light sources, an unlimited combination of light profiles can be achieved.

c) By changing the values of the pre-programmed circuitry, an unlimited combination of light flash duration rates and frequencies can be achieved.

d) By changing the color or texture of the translucent shell material an unlimited number of lighting effects can be achieved.

e) The display is designed to be battery powered and therefore self-contained, requiring no external cords or power sources.

f) The operation of the light display is simple and intuitive g) The display is designed to float freely or be held in place by tether and anchor.

OPERATION—FIG. 8

Initially, the display assembly, consisting of the translucent shell 16, light circuit assembly 20 battery interconnect 26, and reseal-able cap 28 would arrive to the user in a pre-assembled state. The user would then remove the cap 28, insert and connect the battery(s) 24 and replace the cap. The electronic circuitry 10 would be pre-programmed to sense the ambient light and determine the flash pattern, duration, frequency, and intensity of the light source 12 outputs. Before placing the display in the pond, pool or swimming pool, an anchor with a tether line 30 would be affixed to the shell if the display were to be held in a given position. (This is very desirable if several displays are to be arranged in a pattern).

CONCLUSIONS, RAMIFICATIONS, AND SCOPE

Accordingly, the reader will see that this floating light display invention can be used to decorate pools, ponds and swimming pools easily and conveniently without the need for bulky hardware, external wire harnesses or external power supplies. Designed to be sealed from the elements, buoyant in nature, totally self contained and pre-programmed, the display can provide an unlimited number of light flash pattern possibilities whether free floating in the current or anchored in place. The combination of color and flash pattern is intended to produce an "active" light display in a pool or pond rather than a "static" single mode operation.

Although the description above contains much specificity, these should not be construed as hating the scope of the invention but as merely providing illustrations of some of the presently preferred embodiments of this invention.

We claim:

1. A decorative lighting system comprising:

(a) a hollow, waterproof, buoyant, translucent shell;

(b) an electronic circuit board populated with light sources and electronic components for controlling the light sources to turn on and off in a flash pattern, the electronic circuit board being disposed in the shell; and (c) a power source, disposed in the shell and in electrical communication with the electronic circuit board, for powering the light sources and the electronic components; and wherein at least one of the electronic components is an electronic component for sensing a level of ambient light, and wherein the electronic components are pre-programmed to determine the flash pattern in accordance with the level of ambient light.

2. The decorative lighting system of claim 1, further comprising an anchor and tether system for holding the shell in position.

3. The decorative lighting system of claim 1, wherein at least one of the light sources is a light source for emitting colored light.

4. The decorative lighting system of claim 1, wherein the shell has at least one of a color and a texture to impart a decorative effect on light emitted by the light sources.

5. The decorative lighting system of claim 1, wherein the power source comprises a battery.

6. The decorative lighting system of claim 1, further comprising a reseal-able, waterproof cap, attachable to the shell, for permitting access to the power source from outside the shell when the cap is removed from the shell and for maintaining a waterproof, buoyant nature of the shell when the cap is attached to the shell.

7. The decorative lighting system of claim 6, wherein the shell comprises a flattened portion for supporting the shell on a table top.

8. The decorative lighting system of claim 7, wherein the cap is disposed in the flattened portion.

9. A decorative lighting system comprising:

(a) a hollow, waterproof, buoyant, translucent shell;

(b) an electronic circuit board populated with light sources and electronic components for controlling the light sources to turn on and off, the electronic circuit board being disposed in the shell; and (c) a power source, disposed in the shell and in electrical communication with the electronic circuit board, for powering the light sources and the electronic components;

wherein the light sources flash at a flash pattern having a plurality of frequencies and durations.

10. The decorative lighting system of claim 9, wherein the electronic components are pre-programmed to determine the flash pattern of the light sources.

11. The decorative lighting system of claim 10, wherein the electronic components are pre-programmed to determine the flash pattern in terms of duration, frequency, and intensity of a light output from each of the light sources.

12. The decorative lighting system of claim 11, wherein at least one of the electronic components is an electronic component for sensing a level of ambient light, and wherein the electronic components are pre-programmed to determine he flash pattern in accordance with the level of ambient light.

13. The decorative lighting system of claim 9, further comprising a reseal-able, waterproof cap, attachable to the shell, for permitting access to the power source from outside the shell when the cap is removed from the shell and for maintaining a waterproof, buoyant nature of the shell when the cap is attached to the shell.

* * * * *